US011040552B2

(12) United States Patent
Yoda

(10) Patent No.: US 11,040,552 B2
(45) Date of Patent: Jun. 22, 2021

(54) HEATING DEVICE AND DRYING METHOD

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/294,720

(22) Filed: Mar. 6, 2019

(65) Prior Publication Data

US 2019/0275813 A1 Sep. 12, 2019

(30) Foreign Application Priority Data

Mar. 9, 2018 (JP) ..... JP2018-042971

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 2/17556; B41J 2/475
See application file for complete search history.

(56) References Cited

U.S. PATENT DOCUMENTS 6,893,122 B2 * 5/2005 Shima ..... B41J 11/002 219/216
2011/0267393 A1 * 11/2011 Okamoto ..... B41J 11/002 347/14
2016/0159111 A1 * 6/2016 Sasaki ..... B41J 11/002 347/102

FOREIGN PATENT DOCUMENTS

EP 0997301 A 5/2000
JP 2000-135785 A 5/2000

* cited by examiner

*Primary Examiner* — Lam S Nguyen
(74) *Attorney, Agent, or Firm* — Workman Nydegger

(57) ABSTRACT

A heating device configured to heat a medium on which a liquid for printing is impinged includes a heating element configured to face a processing surface, the processing surface being a surface on which the liquid is impinged, a blower configured to blow gas to a heating region between the heating element and the processing surface from the heating element side of the medium, and a control unit configured to control an output of the heating element and a driving amount of the blower. The control unit changes the driving amount of the blower in accordance with a type of the medium while maintaining the output of the heating element constant regardless of the type of the medium. The decrease in the drying efficiency of the medium is suppressed.

3 Claims, 3 Drawing Sheets

| MEDIUM TYPE (LARGE CATEGORY) | MEDIUM (SMALL CATEGORY) | PRINTING MODE | PRINTING SPEED [mm/s] | LIQUID AMOUNT [mg/inch²] | REDRYING PROCESS UPPER LIMIT TEMPERATURE [°C] | REQUIRED ENERGY REQUIRED EVAPORATION AMOUNT FOR DRYING [g/hr] | HEATER TUBE OUTPUT [%] | BLOWER WIND SPEED [m/sec] | PROCESSING TEMPERATURE [°C] | DRYING AMOUNT [g/hr] |
|---|---|---|---|---|---|---|---|---|---|---|
| POLYVINYL CHLORIDE | A | 7Pass | 5.78 | 12 | 115 | 29 | 100 | 1.42 | 87 | 35.14 |
| | | | | | | | 100 | 1.68 | 83 | 29.56 |
| | | | | | | | 100 | 2.11 | 82 | 24.35 |
| | | 9Pass | 4.42 | 16 | 115 | 45 | 100 | 1.62 | 86 | 49.64 |
| | | | | | | | 100 | 1.94 | 82 | 45.39 |
| | | | | | | | 100 | 2.25 | 88 | 39.25 |
| | | | | | | | 100 | 1.42 | 94 | 35.28 |
| | | | | | | | 100 | 1.68 | 84 | 29.68 |
| | | | | | | | 100 | 2.11 | 82 | 27.78 |
| | B | 7Pass | 5.70 | 12 | 120 | 29 | 100 | 1.00 | 100 | 23.80 |
| | | | | | | | 70 | 1.00 | 93 | 16.60 |
| | | | | | | | 100 | 1.31 | 90 | 19.80 |
| BANNER | | 5Pass | 7.90 | 12 | 91.3 | 19 | 100 | 1.62 | 89 | 18.80 |
| | | | | | | | 100 | 1.94 | 85 | 17.80 |
| | | | | | | | 100 | 2.25 | 82 | 16.80 |
| | | 4Pass | 9.50 | 9 | 91.3 | 14 | 100 | 2.25 | 79 | 16.42 |
| | | | | | | | 100 | 2.58 | 75 | 14.60 |
| | | | | | | | 100 | 2.87 | 73 | 13.23 |
| BACKLIT | | 13pass | 3.05 | 32 | 80 75 | 32 | 100 | 1.31 | 107 | 74.23 |
| | | | | | | | 80 | 1.31 | 75 | 50.43 |
| | | | | | | | 100 | 1.94 | 91 | 60.43 |
| | | | | | | | 100 | 2.25 | 83 | 57.44.30 |
| | | | | | | | 100 | 2.58 | 82 | 54.42.19 |
| | | | | | | | 100 | 2.87 | 79 | 52.40.81 |
| | | | | | | | 100 | 3.18 | 68 | 46.32.32 |
| TEXTILE | | 17pass | 2.33 | 16 | 94.3 | 81 | 100 | 1.31 | 104 | 79.84.25 |
| | | | | | | | 70 | 1.31 | 91 | 67.75.45 |
| | | | | | | | 100 | 1.62 | 97 | 84.91.07 |
| | | | | | | | 100 | 1.94 | 92 | 83.77.34 |
| COATED PAPER | | 7pass | 5.70 | 16 | 102.1 | 34 | 100 | 1.31 | 108 | 42.15 |
| | | | | | | | 100 | 1.62 | 95 | 34.03 |
| | | | | | | | 100 | 1.94 | 83 | 32.61 |
| | | | | 12 | | 28 | 100 | 1.94 | 92 | 31.45 |
| | | | | | | | 100 | 2.25 | 88 | 29.60 |
| | | | | | | | 100 | 2.58 | 85 | 28.53 |
| WALLPAPER | | 7pass | 5.70 | 16 | 113.1 | 19 | 100 | 2.58 | 77 | 20.85 |
| | | | | | | | 100 | 2.87 | 74 | 19.55 |
| | | | | | | | 100 | 3.18 | 70 | 17.22 |
| | | | | 12 | | 20 | 100 | 2.58 | 79 | 21.36 |
| | | | | | | | 100 | 2.87 | 76 | 20.33 |
| | | | | | | | 100 | 3.18 | 66 | 15.68 |

F1
F2
F3

| | | | | | | REQUIRED ENERGY | HEATER TUBE | BLOWER | PROCESSING SURFACE TEMPERATURE [°C] | CIRCULATION TEMPERATURE [°C] | DRYING ABILITY |
|---|---|---|---|---|---|---|---|---|---|---|---|
| MEDIUM TYPE (LARGE CATEGORY) | MEDIUM (SMALL CATEGORY) | PRINTING MODE | PRINTING SPEED [mm/s] | LIQUID AMOUNT [mg/inch²] | MEDIUM DAMAGE UPPER LIMIT TEMPERATURE [°C] | REQUIRED EVAPORATION AMOUNT FOR DRYING [g/m²] | OUTPUT [%] | WIND SPEED [m/sec] | MAX | | EVAPORATION AMOUNT [g/m²] |
| POLYVINYL CHLORIDE | A | 7Pass | 5.70 | 12 | 115 | 29 | 100 | 1.42 | 97 | 86 | 35.14 |
| | | | | | | | 100 | 1.68 | 89 | 58 | 29.56 |
| | | | | | | | 100 | 2.11 | 83 | 52 | 24.35 |
| | | 9Pass | 4.42 | 16 | 115 | 45 | 100 | 1.62 | 95 | 60 | 49.84 |
| | | | | | | | 100 | 1.94 | 92 | 58 | 45.39 |
| | | | | | | | 100 | 2.25 | 86 | 52 | 39.25 |
| | B | 7Pass | 5.70 | 12 | 120 | 29 | 100 | 1.42 | 84 | 72 | 35.05 |
| | | | | | | | 100 | 1.68 | 84 | 61 | 29.06 |
| | | | | | | | 100 | 2.11 | 82 | 59 | 27.74 |
| BANNER | | 5Pass | 7.90 | 12 | 91.3 | 19 | 100 | 1.00 | 100 | 73 | 23.00 |
| | | | | | | | 70 | 1.00 | 90 | 67 | 16.00 |
| | | | | | | | 100 | 1.31 | 93 | 67 | 19.00 |
| | | | | | | | 100 | 1.62 | 89 | 62 | 18.00 |
| | | | | | | | 100 | 1.94 | 84 | 58 | 17.00 |
| | | | | | | | 100 | 2.25 | 82 | 54 | 16.00 |
| | | 4Pass | 9.50 | 9 | 91.3 | 14 | 100 | 2.25 | 79 | 54 | 16.42 |
| | | | | | | | 100 | 2.56 | 75 | 51 | 14.62 |
| | | | | | | | 100 | 2.87 | 73 | 49 | 13.33 |
| BACKLIT | | 13pass | 3.05 | 32 | 88 75 | 32 | 100 | 1.31 | 107 | 74 | 74.63 |
| | | | | | | | 80 | 1.31 | 75 | 58 | 38.43 |
| | | | | | | | 100 | 1.94 | 91 | 66 | 53.43 |
| | | | | | | | 100 | 2.25 | 83 | 57 | 44.30 |
| | | | | | | | 100 | 2.56 | 82 | 54 | 42.19 |
| | | | | | | | 100 | 2.87 | 79 | 52 | 40.81 |
| | | | | | | | 100 | 3.18 | 68 | 46 | 32.03 |
| TEXTILE | | 17pass | 2.33 | 16 | 94.9 | 81 | 100 | 1.31 | 104 | 73 | 94.72 |
| | | | | | | | 70 | 1.31 | 91 | 67 | 78.70 |
| | | | | | | | 100 | 1.62 | 94 | 62 | 81.01 |
| | | | | | | | 100 | 1.94 | 92 | 59 | 77.04 |
| COATED PAPER | | 7pass | 5.70 | 16 | 102.1 | 34 | 100 | 1.31 | 108 | 78 | 42.15 |
| | | | | | | | 100 | 1.62 | 95 | 65 | 34.03 |
| | | | | | | | 100 | 1.34 | 93 | 64 | 32.01 |
| | | | | 12 | | 28 | 100 | 1.94 | 92 | 64 | 31.45 |
| | | | | | | | 100 | 2.25 | 89 | 62 | 28.60 |
| | | | | | | | 100 | 2.56 | 85 | 58 | 26.52 |
| WALLPAPER | | 7pass | 5.70 | 16 | 113.1 | 19 | 100 | 2.56 | 77 | 51 | 20.88 |
| | | | | | | | 100 | 2.87 | 74 | 50 | 19.29 |
| | | | | | | | 100 | 3.18 | 70 | 48 | 17.22 |
| | | | | 12 | | 20 | 100 | 2.56 | 78 | 53 | 21.90 |
| | | | | | | | 100 | 2.87 | 76 | 51 | 20.33 |
| | | | | | | | 100 | 3.18 | 66 | 47 | 15.66 |

F1

F2

F3

Fig. 3

| | | | | | | REQUIRED ENERGY | HEATER TUBE | BLOWER | PROCESSING SURFACE TEMPERATURE [°C] | CIRCULATION TEMPERATURE [°C] | DRYING ABILITY |
|---|---|---|---|---|---|---|---|---|---|---|---|
| MEDIUM TYPE (LARGE CATEGORY) | MEDIUM (SMALL CATEGORY) | PRINTING MODE | PRINTING SPEED [mm/s] | LIQUID AMOUNT [mg/inch²] | MEDIUM DAMAGE UPPER LIMIT TEMPERATURE [°C] | REQUIRED EVAPORATION AMOUNT FOR DRYING [g/m²] | OUTPUT [%] | WIND SPEED [m/sec] | MAX | | EVAPORATION AMOUNT [g/m²] |
| POLYVINYL CHLORIDE | A | 7Pass | 5.70 | 12 | 115 | 29 | 100 | 1.88 | 89 | 58 | 29.58 |
| | | 9Pass | 4.42 | 16 | 115 | 45 | 100 | 1.94 | 92 | 58 | 45.39 |
| | B | 7Pass | 5.70 | 12 | 120 | 29 | 100 | 1.88 | 84 | 61 | 29.08 |
| BANNER | | 5Pass | 7.90 | 12 | 91.3 | 19 | 100 | 1.31 | 90 | 67 | 19.00 |
| | | 4Pass | 9.50 | 9 | 91.3 | 14 | 100 | 2.56 | 75 | 51 | 14.62 |
| BACKLIT | | 13pass | 3.05 | 32 | 88.75 | 32 | 100 | 3.18 | 68 | 46 | 32.03 |
| TEXTILE | | 17pass | 2.33 | 16 | 94.3 | 81 | 100 | 1.62 | 94 | 62 | 81.07 |
| COATED PAPER | | 7pass | 5.70 | 16 | 102.1 | 34 | 100 | 1.62 | 95 | 65 | 34.03 |
| | | | | 12 | | 28 | 100 | 2.25 | 89 | 62 | 28.60 |
| WALLPAPER | | 7pass | 5.70 | 16 | 113.1 | 19 | 100 | 2.87 | 74 | 50 | 19.28 |
| | | | | 12 | | 20 | 100 | 2.87 | 76 | 51 | 20.33 |

Fig. 4

HEATING DEVICE AND DRYING METHOD

BACKGROUND

The present disclosure relates to a heating device and a drying method.

JP-A-2000-135785 discloses a printing apparatus including a printing unit that executes printing by attaching a liquid such as ink to a medium, and a heating device that heats the medium on which the printing has been executed by the printing unit. The heating device includes a heating element that heats the medium and a control unit that controls the heating element. The heating element is disposed to face a processing surface, which is one of both front and rear surfaces of the medium and onto which the liquid is discharged. The processing surface of the medium is heated by the heating element, and the medium is dried.

SUMMARY

The medium has a temperature at which medium damage occurs. The medium damage refers to deformation or damage of the medium, and examples thereof include heat shrinkage of the medium. The temperature at which the medium damage occurs differs depending on the type of the medium. The control unit can suppress the occurrence of the medium damage by decreasing the output of the heating element for a medium in which the medium damage occurs at a lower temperature. However, when the output of the heating element is decreased to suppress the occurrence of the medium damage, the temperature of the processing surface decreases. Accordingly, a liquid evaporation amount decreases, thus decreasing the drying efficiency of the medium.

An advantage of the disclosure is to provide a heating device and a drying method that make it possible to suppress a decrease in the drying efficiency of a medium.

Hereinafter, measures for the above-described issues and advantages of the measures will be described.

According to one embodiment, a heating device configured to heat a medium on which a liquid is impinged, the heating device including a heating element configured to face a processing surface, the processing surface being a surface on which the liquid is impinged, a blower configured to blow gas to a heating region between the heating element and the processing surface from the heating element side of the medium, and a control unit configured to control an output of the heating element and a driving amount of the blower. The control unit changes the driving amount of the blower in accordance with a type of the medium while maintaining the output of the heating element constant regardless of the type of the medium.

In the above embodiment, the control unit changes the driving amount of the blower in accordance with the type of the medium. The wind speed of the gas blown by the blower increases as the driving amount of the blower increases. When the wind speed of the gas increases, it is possible to decrease the temperature of the processing surface. Since the control unit causes the output of the heating element to be constant regardless of the type of the medium, the temperature of the processing surface is controlled in accordance with the driving amount of the blower. Since the temperature at which the medium damage occurs differs depending on the type of the medium, it is possible to control the temperature of the processing surface in accordance with the type of the medium by changing the wind speed of the gas in accordance with the type of the medium. This makes it possible to suppress the occurrence of the medium damage in the medium. Further, when the wind speed of the gas increases, the temperature of the processing surface decreases, and liquid evaporation is accelerated accordingly. Therefore, it is possible to suppress the decrease in drying efficiency compared with a case where the temperature of the processing surface is controlled by changing the output of the heating element.

In another embodiment, the heating device further including a flow path. And in the heating device, the blower is provided in the flow path, and an outlet of the flow path through which gas is blown out by driving the blower is configured to face the processing surface.

In the above embodiment, it is possible to define a gas flowing direction by means of the flow path. It is possible to induce the gas toward the processing surface and improve drying efficiency.

In the heating device according to another embodiment, an inlet of the flow path through which gas flows into the flow path is configured to face the processing surface, and a part of the gas blown out of the outlet flows into the flow path from the inlet.

In the above embodiment, a part of the gas blown out of the outlet returns to the flow path from the inlet. That is, a part of the gas circulates. The gas blown out of the outlet is heated by passing through the heating region between the heating element and the processing surface. By circulating the heated gas, it is possible to improve drying efficiency.

In the heating device according to another embodiment, the control unit is configured to change the driving amount of the blower in accordance with an amount of the liquid impinged on the medium.

In the above embodiment, the wind speed of the gas blown on the processing surface changes in accordance with the amount of the liquid attached to the medium. The liquid evaporation amount required to dry the medium differs depending on the amount of the liquid attached to the medium. By changing the driving amount of the blower in accordance with the amount of the liquid attached to the medium, it is possible to appropriately dry the medium.

The heating device according to another embodiment is configured to heat the medium on which the liquid discharged from a head is impinged, the head being configured to discharge the liquid, and that the control unit is configured to change the driving amount of the blower in accordance with the number of passes of the head.

In the above embodiment, the wind speed of the gas blown on the processing surface changes in accordance with the number of passes of the head. In a case where the amount of liquid discharged onto the medium increases as the number of passes of the head increases, it is possible to change the driving amount of the blower in accordance with the amount of liquid discharged onto the medium by changing the driving amount of the blower in accordance with the number of passes of the head. This makes it possible to appropriately dry the medium.

In another embodiment, a drying method for drying a medium on which a liquid is impinged by heating the medium, the drying method including heating a processing surface on which the liquid is impinged by a heating element, the heating element having an output maintained constant, and blowing gas to the medium being heated, from the heating element side of the medium, at a wind speed corresponding to a type of the medium. According to this method, it is possible to suppress the decrease in the drying efficiency of the medium.

BRIEF DESCRIPTION OF THE DRAWINGS

The invention will be described with reference to the accompanying drawings, wherein like numbers reference like elements.

FIG. 3 is a table in which each type of medium is associated with a medium damage upper limit temperature and the like.

FIG. 4 is a table in which each type of medium is associated with a wind speed of gas blown on a processing surface.

DESCRIPTION OF EXEMPLARY EMBODIMENTS

One exemplary embodiment of a heating device included in a printing apparatus will be described below.

Figure 1:
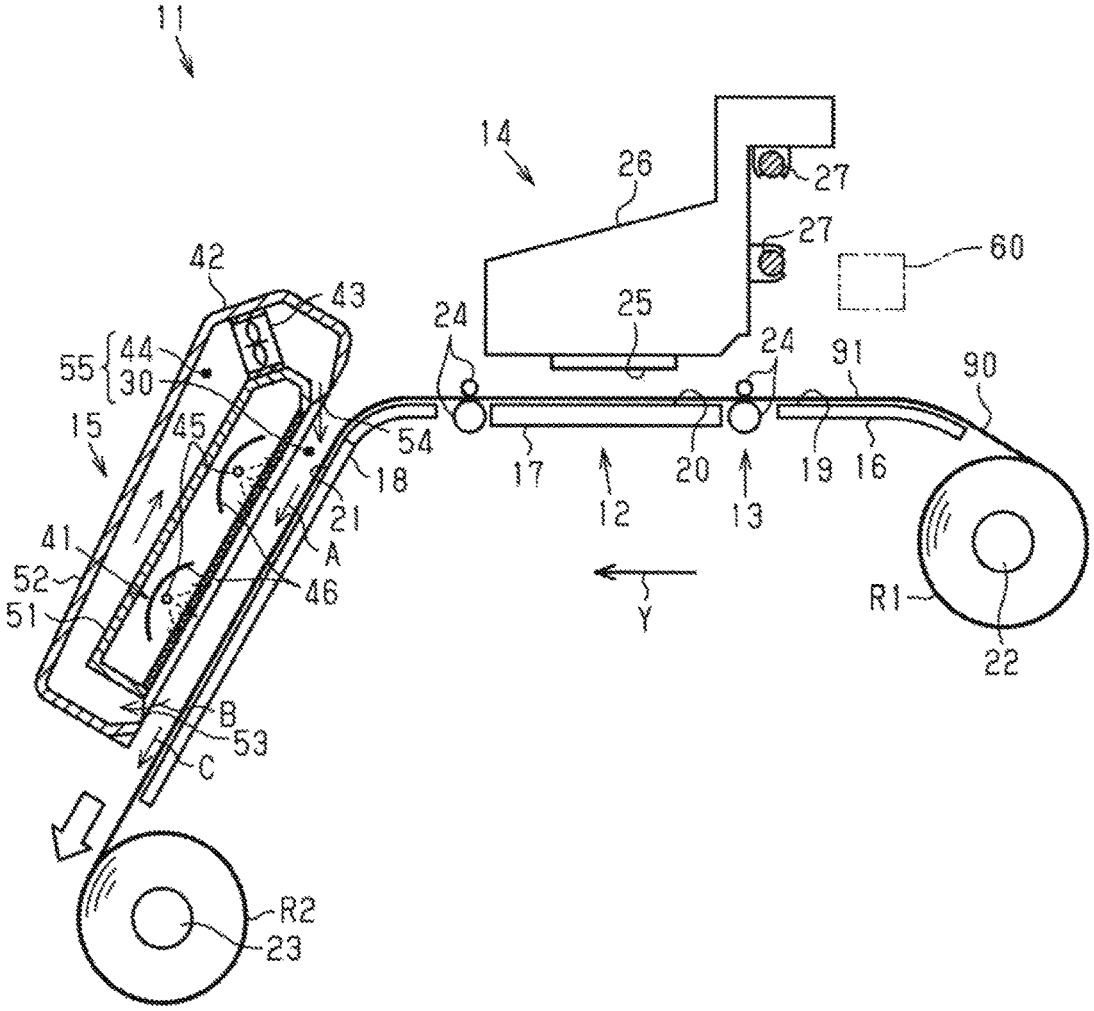
FIG. 1 is a side view schematically illustrating an exemplary embodiment of a printing apparatus.

As illustrated in FIG. 1, a printing apparatus 11 includes a support unit 12 capable of supporting a medium 90, a transport unit 13 that transports the medium 90 along the support unit 12, a printing unit 14 that executes printing on the medium 90, and a heating device 15 that heats the medium 90 after printing. The printing apparatus 11 is, for example, an ink jet-type printer that prints an image such as characters and photographs on the medium 90 by impinging ink, which is an example of a liquid, to the medium 90. The medium 90 is, for example, a long medium such as continuous paper.

The support unit 12 includes a first support plate 16, a second support plate 17, and a third support plate 18. The first support plate 16 includes a support surface 19 for supporting the medium 90 transported by the transport unit 13. The second support plate 17 includes a support surface 20 for supporting the medium 90 transported by the transport unit 13. The third support plate 18 includes a support surface 21 for supporting the medium 90 transported by the transport unit 13. The first support plate 16, the second support plate 17, and the third support plate 18 are arranged in this order in a transport direction of the medium 90. Note that, in the following descriptions, descriptions will be made assuming that the transport direction of the medium 90 is a transport direction Y. The second support plate 17 faces the printing unit 14 and the third support plate 18 faces the heating device 15.

The transport unit 13 includes a first rotation shaft 22 located upstream of the first support plate 16 in the transport direction Y of the medium 90, and a second rotation shaft 23 located downstream of the third support plate 18 in the transport direction Y of the medium 90. The first rotation shaft 22 rotatably supports a roll body R1 around which the medium 90 before printing is wound and rolled into a cylindrical shape. The second rotation shaft 23 rotatably supports a roll body R2 around which the medium 90 after printing is rolled into a cylindrical shape. Transport rollers 24 are disposed between the first support plate 16 and the second support plate 17, and between the second support plate 17 and the third support plate 18. The transport rollers 24 transport the medium 90 by rotating while in contact with the medium 90.

The printing unit 14 includes a head 25 that discharges a liquid such as ink, a carriage 26 that holds the head 25, and a guide shaft 27 that guides the movement of the carriage 26. The head 25 is disposed to face the second support plate 17, and is capable of discharging the liquid onto the medium 90 supported by the second support plate 17. That is, the head 25 is capable of discharging the liquid while reciprocally moving along the guide shaft 27 extending in a direction intersecting the transport direction Y. Further, the printing unit 14 prints an image such as characters and graphics on the medium 90 by impinging the liquid discharged from the head 25 on the medium 90.

Of both front and rear surfaces of the medium 90, the surface on which the liquid discharged from the head 25 is impinged is a processing surface 91. The processing surface 91 of the present exemplary embodiment is a surface, of both front and rear surfaces of the medium 90, facing the head 25 when the medium 90 is supported by the support surface 20 of the second support plate 17.

The heating device 15 heats the medium 90 printed with the image by the printing unit 14 and transported by the transport unit 13. Specifically, the heating device 15 heats the processing surface 91 of the medium 90 supported by the third support plate 18, evaporates the liquid impinged on the medium 90 by the heating, and dries the medium 90.

The heating device 15 faces the support surface 21 of the third support plate 18. The heating device 15 is disposed apart from the support surface 21. A space between the support surface 21 and the heating device 15 is a heating region 30 that is heated by the heating device 15. The medium 90 transported by the transport unit 13 passes through the heating region 30.

The heating device 15 will be described in detail below.

i. The heating device 15 includes a heating unit 41 for heating the medium 90, a housing 42 that accommodates the heating unit 41, and a blower 43 for blowing gas. The heating unit 41 heats the medium 90 supported by the support surface 21 of the third support plate 18. The heating unit 41 is disposed at a position facing the support surface 21. The heating unit 41 includes heater tubes 45, which is an example of a heating element capable of generating heat. The two heater tubes 45 of the present exemplary embodiment are arranged side by side in the transport direction Y. The heater tubes 45 are capable of facing the processing surface 91 of the medium 90 supported by the third support plate 18.

The heating unit 41 may include reflection plates 46 for reflecting infrared rays of the heater tubes 45. In this case, the reflection plates 46 are preferably disposed to surround a portion of the circumferential surface of the heater tubes 45 not facing the support surface 21. The reflection plates 46 reflect infrared rays generated by the heater tubes 45 toward the support surface 21. Note that, in a case where the reflection plates 46 are included, the range of the heating region 30 changes in accordance with the positions of the heater tubes 45 and the reflection plates 46.

The housing 42 includes an inner wall 51 surrounding the heating unit 41, and an outer wall 52 surrounding the inner wall 51. The outer wall 52 is disposed outside the inner wall 51. A flow path 44 in which gas flows is sectioned between the inner wall 51 and the outer wall 52. It is considered that the housing 42 includes the flow path 44. Both ends of the flow path 44 open toward the support surface 21.

The flow path 44 is sectioned to surround the heating unit 41. The flow path 44 includes an inlet 53 for causing gas to flow into the flow path 44, and an outlet 54 for blowing out the gas from the flow path 44. In the other words, the flow path 44 includes the inlet 53 through which the gas flow into the flow path 44, and the outlet 54 through which the gas blowing out from the flow path 44. The inlet 53 and the outlet 54 open toward the heating region 30. This causes the flow path 44 of the gas to communicate with the heating region 30 for heating the medium 90.

The blower 43 is disposed in the flow path 44. The blower 43 causes the gas in the flow path 44 to flow toward the outlet 54. Further, by the blower 43 causing the gas in the flow path 44 to flow, the gas flows into the flow path 44 from the inlet 53. The gas in the flow path 44 is, for example, air.

The inlet 53 is located at a position that is in a first direction from the heating unit 41, the first direction is along the transport direction Y and the first direction is opposite to a direction, along the transport direction Y, from the heating unit 41 to the printing unit 14. That is, the inlet 53 is located downstream from the heating unit 41 in the transport direction Y. The outlet 54 is located on a side of the heating unit 41 in the transport direction Y, on which the printing unit 14 is located. That is, the outlet 54 is located upstream from the heating unit 41 in the transport direction Y.

The outlet 54 opens downstream from the outlet 54 in the transport direction Y. In other words, the outlet 54 opens such that the gas blown out of the outlet 54 flows to a position downstream from the outlet 54, at which the inlet 53 is located.

After being blown onto the medium 90 supported by the support surface 21, the gas blown out of the outlet 54 flows in the transport direction Y along the processing surface 91 as indicated by an arrow A in FIG. 1. The inlet 53 and the outlet 54 open at positions at which it is possible to face the processing surface 91 of the medium 90. Thus, the gas blown out of the outlet 54 is blown out toward the processing surface 91. It is considered that the blower 43 is capable of blowing the gas from the heater tube side of the medium, on which the heater tube 45 is disposed, toward the heating region 30.

A part of the gas blown out of the outlet 54 and flowing along the processing surface 91 flows into the inlet 53 as indicated by an arrow B. That is, a part of the gas circulates in the flow path 44 and the heating region 30. It is considered that the flow path 44 and the heating region 30 constitute a circulation path 55 of the gas. A part of the gas blown out of the outlet 54 and flowing along the processing surface 91 is discharged from between the inlet 53 and the support surface 21 to the outside of the circulation path 55 as indicated by an arrow C.

The gas circulating in the circulation path 55 is heated by the heating unit 41. This causes the temperature of the gas blown out of the outlet 54 to be higher than that in a case where the gas is not caused to circulate. That is, since the gas heated by the heating unit 41 is contained in the gas flowing along the processing surface 91, the temperature of the gas flowing along the processing surface 91 becomes higher than that in a case where the gas is not caused to circulate. Further, the flow path 44 is located to surround the heating unit 41, and thus, the temperature in the flow path 44 increases due to the heat generated by the heating unit 41. By the circulating gas passing through the flow path 44, the heat generated by the heater tubes 45 can be collected and reused for drying.

When the heating unit 41 heats the medium 90, vapor is generated by the evaporation of the liquid impinged on the medium 90. When the humidity of the circulation path 55 is increased due to the vapor, the medium 90 is hard to dry. Therefore, the heating device 15 discharges the vapor with a part of the gas blown out of the outlet 54 to the outside of the circulation path 55 from between the inlet 53 and the support surface 21. Thus, the increase in humidity in the circulation path 55 is suppressed.

The heating device 15 dries the medium 90 by blowing gas onto the medium 90 while heating the medium 90 supported by the support surface 21. That is, when the medium 90 after printing is transported along the support unit 12 and reaches the heating region 30 between the heating device 15 and the support surface 21, the evaporation of the liquid impinged on the medium 90 is promoted by the heat generated by the heater tubes 45 and the gas blown out of the outlet 54. It is considered that the heating device 15 dries the processing surface 91 by the radiant heat from the heater tubes 45 and the gas blown by the blower 43.

Next, an electrical configuration of the printing apparatus 11 will be described.

Figure 2:
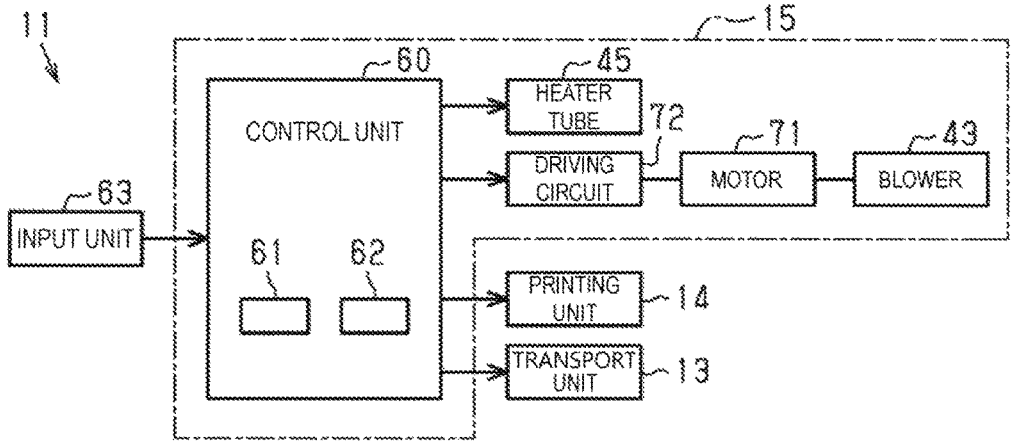
FIG. 2 is an electric block diagram illustrating an electrical configuration of a printing apparatus.

As illustrated in FIG. 1 and FIG. 2, the printing apparatus 11 includes a control unit 60. The control unit 60 includes a CPU 61 and a storage unit 62 constituted of a RAM, a ROM, etc. Various programs for controlling the printing apparatus 11 are stored in the storage unit 62. The control unit 60 may include dedicated hardware (Application Specific Integrated Circuit: ASIC) that executes at least a part of processing among the various types of processing.

That is, the control unit 60 can be configured as one or more processors that operate in accordance with a computer program (software), one or more dedicated hardware circuits such as an ASIC, etc., or a circuit including a combination of the processors and the dedicated hardware circuits. The processors include a CPU and a memory such as a RAM, a ROM, etc. The memory stores a program code or a command configured to cause the CPU to execute processing. The memory, i.e., a computer-readable medium includes anything that can be accessed by a general-purpose or dedicated computer.

The heating device 15 includes a motor 71 for driving the blower 43, and a driving circuit 72 for driving the motor 71. The driving circuit 72 is a motor driver that controls the driving amount of the blower 43 by controlling the voltage applied to the motor 71. Note that, as the driving circuit 72, a driving circuit that controls the driving amount of the blower 43 by executing PWM control may be used. That is, the driving circuit 72 may be a driving circuit capable of controlling the driving amount of the blower 43 by controlling the motor 71.

The heater tubes 45, the driving circuit 72, the transport unit 13, and the printing unit 14 are electrically connected to the control unit 60. The control unit 60 operates the printing apparatus 11 by controlling the heater tubes 45, the driving circuit 72, the transport unit 13, and the printing unit 14. The control unit 60 controls the heater tubes 45 and the driving circuit 72, which are a part of the heating device 15, and thus, it is considered that the control unit 60 is a part of the heating device 15.

The printing apparatus 11 includes an input unit 63 connected to the control unit 60. The input unit 63 is for inputting, to the control unit 60, the type of the medium 90 on which printing is executed by the printing unit 14. The input unit 63 is, for example, an operation panel operated by the user of the printing apparatus 11. The control unit 60 controls the driving circuit 72 in accordance with the type of the medium 90 input by the input unit 63. Thus, the voltage applied to the motor 71 changes in accordance with the type of the medium 90, and the driving amount of the blower 43 is changed in accordance with the type of the medium 90. The wind speed of the gas blown by the blower 43 changes in accordance with the driving amount of the blower 43. The wind speed of the gas blown by the blower 43 increases as the driving amount of the blower 43 increases. The control of the heating device 15 executed by the control unit 60 when drying the medium 90 will be described in detail below.

The control unit 60 controls the output of the heater tubes 45. The control unit 60 keeps the output of the heater tubes 45 constant regardless of the type of the medium 90. In the present exemplary embodiment, the output of the heater tubes 45 is kept at the maximum output, i.e., 100%. Note that "constant" here includes the fluctuation of the output to such an extent that there is no effect on the temperature generated by the heater tubes 45 or that the effect on the temperature generated by the heater tubes 45 can be ignored. That is, "constant" includes the fluctuation of the output to such an extent that there is no effect on the drying of the medium 90.

The control unit 60 changes the wind speed of the gas flowing in the heating region 30 in accordance with the type of the medium 90 by changing the driving amount of the blower 43 in accordance with the type of the medium 90. Further, the control unit 60 changes the driving amount of the blower 43 in accordance with the amount of liquid discharged onto the medium 90 in addition to the type of the medium 90. The control unit 60 controls the surface temperature of the medium 90, i.e., the temperature of the processing surface 91 by changing the wind speed of the gas while keeping the output of the heater tubes 45 constant. The control unit 60 controls the driving amount of the blower 43 such that the temperature of the processing surface 91 does not exceed an acceptable temperature and a liquid evaporation amount required to dry the medium 90 can be secured.

The liquid evaporation amount required to dry the medium 90 differs depending on the amount of liquid discharged onto the medium 90 and the type of the medium 90. FIG. 3 illustrates, as an example, liquid evaporation amounts required to dry the medium 90 in a case where ink is used as a liquid in association with the types of the medium 90 and liquid amounts. Further, FIG. 3 illustrates, in association with the types of the medium 90, medium damage upper limit temperatures, the relationship between wind speeds and the temperatures of the processing surface 91, the relationship between wind speeds and the temperatures of the gas circulating in the circulation path 55, the relationship between wind speeds and liquid evaporation amounts, etc. Note that the numerical values in the table illustrated in FIG. 3 are examples, and each numerical value can change depending on various elements, such as an environment temperature, the blowing amount of the blower 43, and the size of the heating region 30 in the transport direction Y.

As illustrated in FIG. 3, the liquid evaporation amount required to dry the medium 90 differs depending on the amount of liquid discharged onto the medium 90 and the type of the medium 90. The amount of liquid discharged onto the medium 90 differs depending on the number of passes of the head 25, an image resolution, etc. The number of passes of the head 25 refers to the number of printing operations executed by the head 25 for one printing area. That is, it is also considered that the number of passes is the number of times of scanning executed by the head 25 for printing the one printing area. There is a case where the amount of liquid discharged onto the medium 90 increases as the number of passes increases. The liquid evaporation amount required to dry the medium 90 increases as the amount of liquid increases.

Further, the medium damage upper limit temperature differs depending on the type of the medium 90. In FIG. 3, as examples of the medium 90, polyvinyl chloride, banner (banner flag), backlit (backlight film), textile, coated paper, and wallpaper are listed. Note that each type of the medium 90 illustrated in FIG. 3 is a generic type including a plurality of media 90. For example, in a case of polyvinyl chloride, a polyvinyl chloride A and a polyvinyl chloride B have different specifications, and can be considered as different media 90. In the following descriptions, as appropriate, descriptions will be made by referring to categories each including a plurality of media 90, such as polyvinyl chloride, banner, backlit material, textile, coated paper, and wall paper as large categories, and by referring to categories for individual media 90 of each medium 90 included in the large categories, such as the polyvinyl chloride A and the polyvinyl chloride B as small categories.

Medium damage refers to the deformation or damage of the medium 90, and the examples of the medium damage include the heat shrinkage of the medium 90. The medium 90 has a temperature at which the medium damage occurs. The temperature at which the medium damage occurs is determined by the temperature characteristics of a material constituting the medium 90. Since the material differs depending on the type of the medium 90, the temperature at which the medium damage occurs differs depending on the type of the medium 90. Further, even the media 90 belonging to the same large category have different specifications. For example, as illustrated in FIG. 3, in the case of polyvinyl chloride, the polyvinyl chloride A and the polyvinyl chloride B have different specifications, and temperatures at which the medium damage occurs are also different.

For the medium 90, a medium damage upper limit temperature is set considering the above-described temperature at which the medium damage occurs. The medium damage upper limit temperature is an upper limit of a temperature at which the medium damage occurring in the medium 90 is acceptable. For example, an acceptable temperature of the processing surface 91 is the medium damage upper limit temperature. Note that, considering a margin, etc., the acceptable temperature of the processing surface 91 may be a temperature lower than the medium damage upper limit temperature. That is, the acceptable temperature of the processing surface 91 can be set, as appropriate, within a range from a temperature at which the medium damage starts to occur to the medium damage upper limit temperature. Further, the control unit 60 controls the temperature of the processing surface 91 such that the temperature of the processing surface 91 does not exceed the acceptable temperature.

As illustrated in FIG. 3, the temperature rise of the processing surface 91 can be suppressed by increasing the wind speed of the gas blown by the blower 43. This is because a heat amount removed from the heater tubes 45 increases by increasing the wind speed, and because a gas temperature decreases as the ventilation rate of the circulation path 55 increases. The control unit 60 is capable of controlling the temperature of the processing surface 91 by changing the wind speed.

As illustrated in FIG. 4, the control unit 60 changes the wind speed of the gas, i.e., the driving amount of the blower 43 in accordance with the type of the medium 90 belonging to the large category. The storage unit 62 stores voltage information in association with the type of the medium 90 belonging to the large category. The control unit 60 controls the driving circuit 72 such that a voltage corresponding to the type of the medium 90 set by the input unit 63 is applied to the blower 43. By doing so, the blower 43 is controlled to have a wind speed corresponding to the type of the medium 90. In the present exemplary embodiment, the control unit 60 controls the driving circuit 72 to provide, among wind speeds at which the liquid evaporation amount required to dry the medium 90 can be secured, a wind speed at which the temperature of the processing surface 91 becomes the lowest.

Further, even in a case where the same medium 90 is dried, the control unit 60 changes the wind speed of the gas, i.e., the driving amount of the blower 43 in accordance with the amount of liquid discharged onto the medium 90. For example, as illustrated in FIG. 4, in a case where printing on a polyvinyl chloride is executed, the amount of liquid becomes less in a case of a seven-pass printing mode than in a case of a nine-pass printing mode (the number of passes of the head 25 is set to nine) and the liquid evaporation amount required to dry the medium 90 also becomes less in the case of the seven-pass printing mode than in the case of the nine-pass printing mode. In the example illustrated in FIG. 4, the printing speed in the nine-pass printing mode is slower than the printing speed in the seven-pass printing mode. Drying in the nine-pass printing mode takes longer than in the seven-pass printing mode, and thus, the temperature of the processing surface 91 is easier to rise in the nine-pass printing mode. The control unit 60 suppresses the temperature rise of the processing surface 91 by causing the wind speed in the nine-pass printing mode to be faster than the wind speed in the seven-pass printing mode, thus suppressing the occurrence of the medium damage. It is considered that the control unit 60 changes the driving amount of the blower 43 in accordance with the number of passes of the head 25.

Here, it is also possible to control the temperature of the processing surface 91 by causing the driving amount of the blower 43 to be constant and changing the output of the heater tubes 45 in accordance with the type of the medium 90. However, in a case where the temperature of the processing surface 91 is controlled by changing the output of the heater tubes 45, the occurrence of the medium damage can be suppressed, but drying ability tends to be insufficient. For example, in the part indicated by frame F1 in FIG. 3, examples are provided for cases that the surface temperature of the banner is made 90° C. by changing the output of the heater tubes 45 and that the surface temperature of the banner is made 90° C. by changing the driving amount of the blower 43. It can be seen that the drying ability is higher and the liquid evaporation amount is greater in the case where the output of the heater tubes 45 is changed than in the case where the driving amount of the blower 43 is changed even if the surface temperatures of the processing surface 91 of the banner are the same temperature. This is because the volatilization effect caused by the blown gas increases by increasing the wind speed to decrease the temperature of the processing surface 91, and because the humidity around the processing surface 91 decreases as the ventilation rate of the circulation path 55 increases.

Further, as indicated in frame F2 and frame F3 in FIG. 3, a similar issue can occur in the case where the temperature of the processing surface 91 is controlled by changing the output of the heater tubes 45 even in a case where the medium 90 is made of a backlit material or textile.

As described above, in the case where the output of the heater tubes 45 is changed while causing the wind speed of the gas to be constant, it is difficult to suppress the occurrence of the medium damage and provide high drying efficiency. As a result, in order to secure the liquid evaporation amount required to dry the processing surface 91, printing needs to be executed at a slower speed than the printing speed indicated in FIG. 3, and productivity decreases accordingly.

Meanwhile, in the case where the driving amount of the blower 43 is changed while maintaining the output of the heater tubes 45 constant, it is possible to suppress the temperature rise of the processing surface 91, and suppress the decrease in drying efficiency caused by the suppression of the temperature rise of the processing surface 91. That is, it is possible to suppress the occurrence of the medium damage and suppress the insufficiency of drying ability. As a result, it is possible to cause the printing speed to be faster than the printing speed in the case where the output of the heater tubes 45 is changed while causing the wind speed of the gas to be constant.

Next, the operation of the heating device 15 and a drying method using the heating device 15 will be described.

i. In a case where printing on the medium 90 is executed by means of the printing apparatus 11, a user of the printing apparatus 11 selects the type of the medium 90 by means of the input unit 63. When the printing apparatus 11 executes the printing, the control unit 60 controls driving circuit 72 to provide a wind speed corresponding to the type of the medium 90 input by the input unit 63 and a liquid amount. Further, the control unit 60 keeps the output of the heater tubes 45 constant.

By doing so, in the drying method using the heating device 15, the processing surface 91 of the medium 90 is heated by the radiant heat from the heater tubes 45 the output of which is kept constant. Further, the gas blown out of the outlet 54 to the medium 90 being heated is blown from the heater tube side of the medium 90.

i. By changing the driving amount of the blower 43 in accordance with the type of the medium 90, the wind speed of the gas blown on the processing surface 91 becomes a wind speed corresponding to the type of the medium 90.

According to the exemplary embodiment described above, the following advantages can be obtained.

(1) The control unit 60 changes the driving amount of the blower 43 in accordance with the type of the medium 90. The wind speed of the gas blown by the blower 43 increases as the driving amount of the blower 43 increases. When the wind speed of the gas increases, it is possible to decrease the temperature of the processing surface 91. The control unit 60 causes the output of the heater tubes 45 to be constant regardless of the type of the medium 90, and thus, the temperature of the processing surface 91 is controlled in accordance with the driving amount of the blower 43. Since the temperature at which the medium damage occurs differs depending on the type of the medium 90, it is possible to control the temperature of the processing surface 91 in accordance with the type of the medium 90 by changing the wind speed of the gas in accordance with the type of the medium 90. This makes it possible to suppress the occurrence of the medium damage in the medium 90. Further, when the wind speed of the gas increases, the humidity around the processing surface 91 decreases, and liquid evaporation is accelerated accordingly. Therefore, it is possible to suppress the decrease in drying efficiency compared with the case where the temperature of the processing surface 91 is controlled by changing the output of the heater tubes 45.

(2) It is possible to define a gas flowing direction by means of the flow path 44. It is possible to induce the gas toward the processing surface 91 and improve drying efficiency.

(3) A part of the gas blown out of the outlet 54 returns to the flow path 44 from the inlet 53. That is, a part of the gas circulates. The gas blown out of the outlet 54 is heated by passing through the heating region 30 between the heater tubes 45 and the processing surface 91. By circulating the heated gas, it is possible to improve drying efficiency.

(4) The wind speed of the gas blown on the processing surface 91 changes in accordance with the amount of liquid discharged onto the medium 90. The liquid evaporation amount required to dry the medium 90 differs depending on the amount of liquid discharged onto the medium 90. By changing the driving amount of the blower 43 in accordance with the amount of liquid discharged onto the medium 90, it is possible to appropriately dry the medium 90.

(5) The wind speed of the gas blown on the processing surface 91 changes in accordance with the number of passes of the head 25.

In a case where the amount of liquid discharged onto the medium 90 increases as the number of passes of the head 25 increases, it is possible to change the driving amount of the blower 43 in accordance with the amount of liquid discharged onto the medium 90 by changing the driving amount of the blower 43 in accordance with the number of passes of the head 25. This makes it possible to appropriately dry the medium 90.

The exemplary embodiment described above may be modified as follows. Modifications described below may be appropriately combined.

As described in the exemplary embodiment, the amount of liquid discharged onto the medium 90 differs depending on a resolution. Thus, the control unit 60 may cause the driving amount of the blower 43 to be different in accordance with the resolution.

The control unit 60 may control the driving amount of the blower 43 in accordance with the type of the medium 90 regardless of the amount of liquid discharged onto the medium 90. That is, the control unit 60 may control the driving amount of the blower 43 in accordance with at least the type of the medium 90.

The inlet 53 may not open at a position capable of facing the processing surface 91. For example, the inlet 53 may open to take in the gas from the outside of the heating region 30. In this case, the gas blown by the blower 43 may not circulate.

The blower 43 may blow the gas to the processing surface 91 without the intervention of the flow path 44. For example, the blower 43 may be disposed to face the processing surface 91 such that the gas is blown on the processing surface 91 when the blower 43 is driven. In this case, the housing 42 may not include the flow path 44.

The gas may be blown by means of a pump instead of the blower 43. That is, the printing apparatus 11 may include a generation device that generates air flow.

The type of the medium 90 may be specified by a host device communicably connected to the printing apparatus 11 through wire or radio wave. By operating the host device, a print job is instructed to the printing apparatus 11. The print job includes various commands required for the print control, print condition information of printing conditions such as a print mode designated by the user, and print image data. By including the type of the medium 90 in the printing condition information, it is possible for the host device to specify the type of the medium 90.

The printing apparatus 11 may include a recognition unit that recognizes the type of the medium 90. The recognition unit may recognize the type of the medium 90 by reading, for example, a mark such as a bar code or a QR code (registered trademark) attached to the medium 90. Further, the recognition unit may recognize the type of the medium 90 from imaging data obtained by imaging the medium 90. The control unit 60 controls the driving amount of the blower 43 in accordance with the type of the medium 90 recognized by the recognition unit.

The control unit 60 may change the driving amount of the blower 43 in accordance with the medium 90 belonging to the small category such as the polyvinyl chloride A or the polyvinyl chloride B. For example, the control unit 60 may cause the driving amount of the blower 43 to be greater in a case where the polyvinyl chloride A is dried than in a case where the polyvinyl chloride B is dried. By doing so, it is possible to set the driving amount of the blower 43 appropriate for the medium 90 more finely.

Note that the driving amount of the blower 43 corresponding to the medium 90 belonging to the small category may be obtained through a network. For example, as initial settings, the medium 90 belonging to the large category and the driving amount of the blower 43 associated with the medium 90 belonging to the large category are stored in the storage unit 62. When a user obtains the medium 90 by purchasing the medium 90, etc., the user obtains the driving amount of the blower 43 corresponding to the medium 90 through a network. By doing so, the driving amount of the blower 43 corresponding to the medium 90 possessed by the user is stored in the storage unit 62.

In a case where the heating device 15 includes a plurality of blowers 43, the control unit 60 may control the driving amount of each of the blowers 43 in accordance with the type of the medium 90. That is, the control unit 60 may be capable of causing the wind speed of the gas flowing in the heating region 30 to be a speed corresponding to the type of the medium 90, and in a case where there are a plurality of blowers 43 that affect the wind speed of the gas flowing in the heating region 30, the wind speed may be changed by changing the driving amounts of the plurality of blowers 43.

As described in the exemplary embodiment, when the liquid evaporation amount required to dry the medium 90 decreases, the medium 90 can be dried even when the temperature of the processing surface 91 is decreased. Thus, in a case where the printing speed of the seven-pass printing mode and the printing speed of the nine-pass printing mode are the same, the control unit 60 may cause the driving amount of the blower 43 to be greater in the seven-pass printing mode than in the nine-pass printing mode. The control unit 60 can suppress the temperature rise of the processing surface 91 by increasing the wind speed as the number of passes decreases, i.e., as the amount of liquid discharged onto the medium 90 decreases.

The output of the heater tubes 45 may be constant and may be kept at, for example, 90%.

The driving amount of the blower 43 corresponding to the type of the medium 90 may be changed, as appropriate, within a range in which the temperature of the processing surface 91 does not exceed an acceptable temperature, and in which the liquid evaporation amount required to dry the medium 90 can be secured.

A control unit that controls the heating device 15 and a control unit that controls the printing unit 14 or the transport unit 13 may be provided separately.

The heating device 15 may be detachably mounted to the printing apparatus 11.

The printing apparatus 11 may execute printing on the medium 90 by using other methods than the method in which the liquid discharged from the head 25 is supplied to the medium 90, such as a method in which liquid on a stencil is transferred onto the medium 90.

The heating element included in the heating unit 41 is not limited to the heater tubes 45, and may be a heating wire, a heat source lamp, and the like.

The liquid discharged by the printing unit 14 is not limited to ink, and may be, for example, a liquid material in which particles of a functional material are dispersed or mixed in a liquid. For example, the printing unit 14 may discharge a liquid material containing a material such as an electrode material or a color material (pixel material) used in the manufacture of liquid crystal displays, electroluminescent (EL) displays, surface emitting displays, and the like in a dispersed or dissolved form.

The printing apparatus 11 may be a page printer that executes printing page-by-page.

The heating device 15 may be used to promote drying of objects other than a printed medium.

This application claims priority under 35 U.S.C. § 119 to Japanese Patent Application No. 2018-042971, filed Mar. 9, 2018. The entire disclosure of Japanese Patent Application No. 2018-042971 is hereby incorporated herein by reference.

What is claimed is:

1. A heating device configured to heat a medium on which a liquid discharged from a head is impinged, the heating device comprising:

a heating element configured to face a processing surface, the processing surface being a surface on which the liquid is impinged;

a blower configured to blow gas to a heating region between the heating element and the processing surface from the heating element side of the medium; and a control unit configured to control an output of the heating element and a driving amount of the blower, wherein the control unit changes the driving amount of the blower in accordance with a type of the medium and with a number of passes of the head while maintaining the output of the heating element constant regardless of the type of the medium.

2. The heating device according to claim 1, wherein the control unit is configured to change the driving amount of the blower in accordance with an amount of the liquid impinged on the medium.

3. A drying method for drying a medium on which a liquid discharged from a head is impinged by heating the medium, the drying method comprising:

heating a processing surface on which the liquid is impinged by a heating element, the heating element having an output maintained constant; and blowing gas by a blower to the medium being heated, from the heating element side of the medium, at a wind speed corresponding to a type of the medium and a number of passes of the head.

* * * * *